United States Patent [19]

Long

[11] 4,173,605

[45] Nov. 6, 1979

[54] LIQUID COOLING TOWER

[75] Inventor: Robert Long, Santa Rosa, Calif.

[73] Assignee: Ecodyne Corporation, Lincolnshire, Ill.

[21] Appl. No.: 939,759

[22] Filed: Sep. 5, 1978

[51] Int. Cl.[2] ..... B01F 3/04

[52] U.S. Cl. ..... 261/109; 52/473; 98/121 R; 261/DIG. 11

[58] Field of Search ..... 261/109, 106, 111, DIG. 11; 52/473; 98/40 VM, 121 R

[56] References Cited

U.S. PATENT DOCUMENTS

| | | | |
|---|---|---|---|
| 1,228,207 | 5/1917 | Hart, Jr. | 261/DIG. 11 |
| 1,545,123 | 7/1925 | Burhorn | 52/473 X |
| 1,567,415 | 12/1925 | Burhorn | 261/DIG. 11 |
| 1,728,498 | 9/1928 | Mart | 261/DIG. 11 |
| 2,397,458 | 4/1946 | Allen | 261/DIG. 11 |
| 2,890,870 | 6/1959 | Spiselman | 261/109 X |
| 2,915,302 | 12/1959 | Jacir | 261/109 X |
| 3,031,173 | 4/1962 | Kohl et al. | 261/106 |
| 3,647,191 | 3/1972 | Fordyce | 261/111 |
| 3,756,138 | 9/1973 | Box | 98/40 VM |
| 3,780,999 | 12/1973 | Fordyce | 261/109 |

*Primary Examiner*—Richard L. Chiesa
*Attorney, Agent, or Firm*—Charles M. Kaplan; Joel E. Siegel

[57] ABSTRACT

A liquid cooling tower has a series of vertically spaced rows of unitary louver panels for controlling air flow into the tower and for preventing escape of liquid falling through the tower. The panels are non-planar, and they are shaped so as to increase their stiffness for withstanding wind and ice loads.

29 Claims, 26 Drawing Figures

Fig. 1.
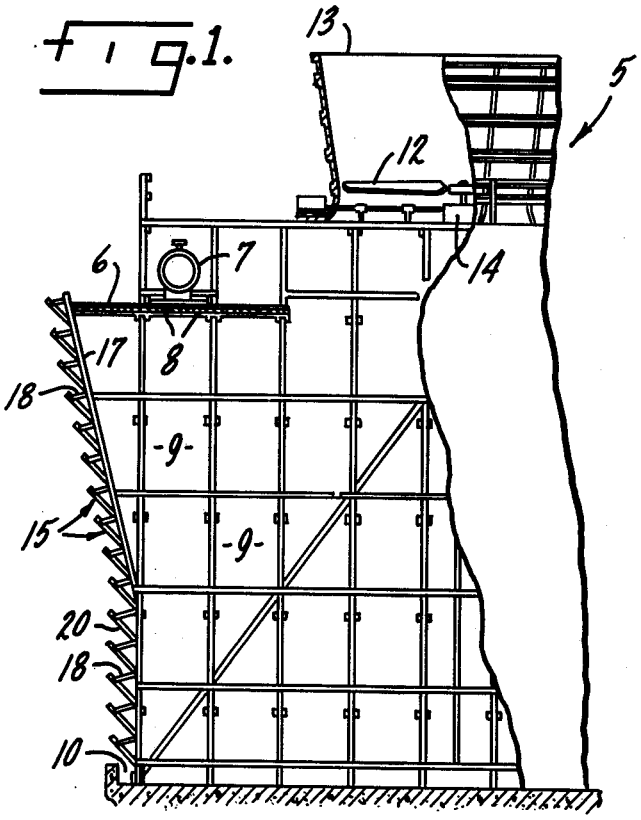
Fig. 2.
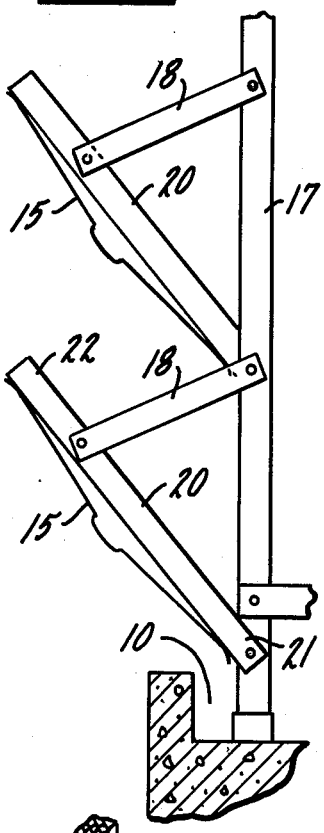
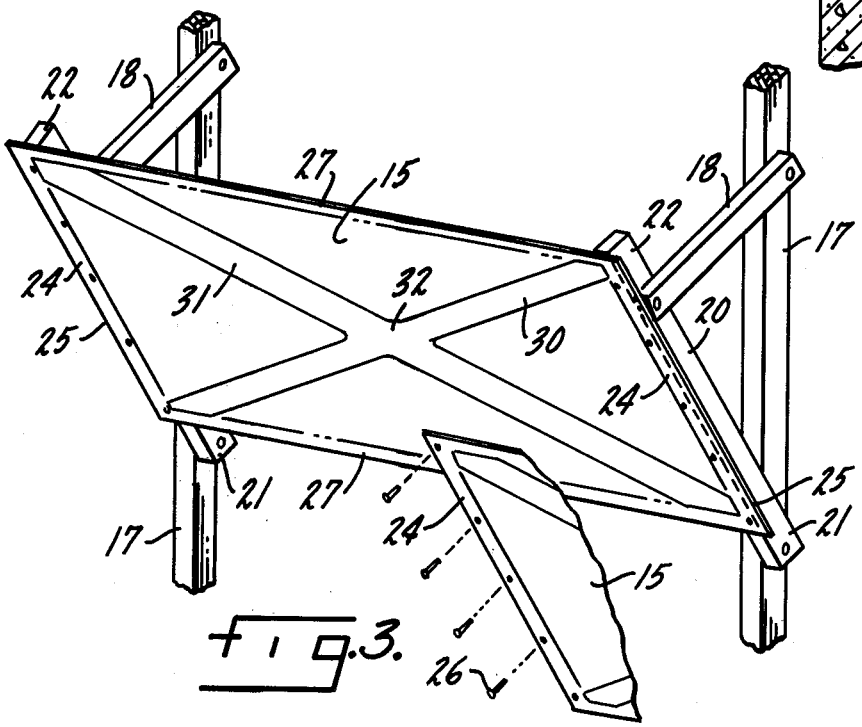
Fig. 3.

Fig. 11.
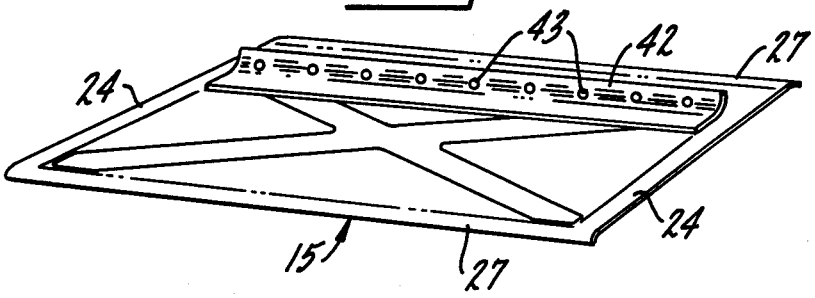
Fig. 12.
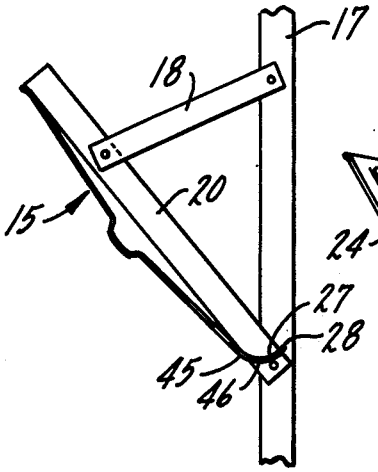
Fig. 13.
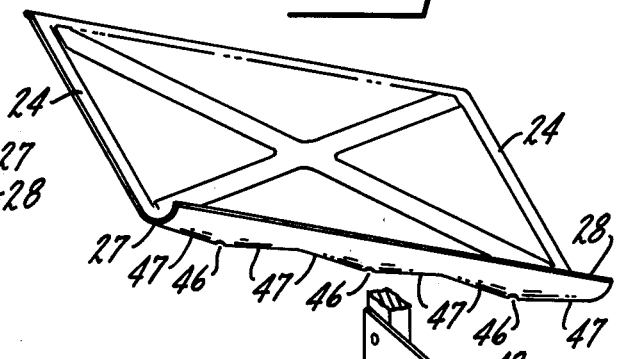
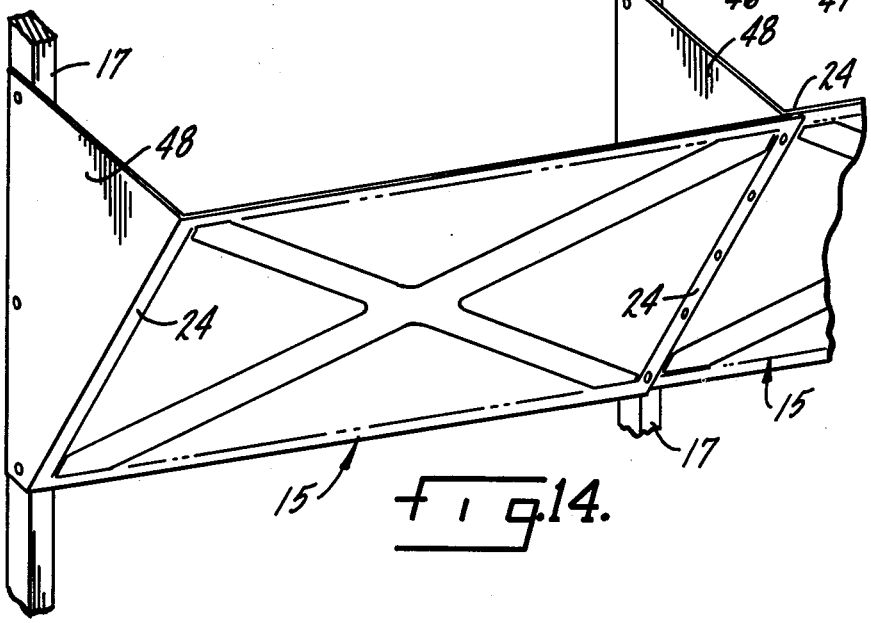
Fig. 14.

LIQUID COOLING TOWER

BACKGROUND OF THE INVENTION

This invention relates to liquid cooling towers and more particularly to improved louver panels for such towers.

At the air inlet of a water cooling tower, louver panels are used to promote uniform air flow into the tower and to catch splashing water that has escaped from the tower. The wind and ice loads encountered by louver panels can be very large, and this has resulted in the use of substantial reinforcing structure to support prior panels. Such reinforcing structure increased the resistance of the panels to air flow and this increased the power consumed in the operation of the tower. Also the accumulation of ice on such panels during cold weather restricted or blocked air flow, and also caused a safety hazard to anyone near the tower.

OBJECTIVE OF THE INVENTION

Accordingly, it is an object of this invention to provide an improved liquid cooling tower.

Another object is to provide cooling tower louver panels that do not have to be structurally reinforced.

Another object is to reduce the wind resistance of cooling tower louver panel assemblies.

Another object is to regulate the way in which ice forms on the louver panels of a liquid cooling tower.

Another object is to control the flow of water that splashes on a cooling tower louver panel.

Another object is to provide cooling tower louver panels that present fewer safety risks during their installation and during operation of the towers.

Another object is to reduce the power consumed during operation of a cooling tower.

Another object is to provide unitary, molded louver panels for a water cooling tower that are strong, durable, streamlined, relatively low cost, easily installed and maintained, and which do not possess defects found in prior art louvers.

Other objects and advantages of the invention will be apparent from the specification and claims, and the scope of the invention will be set forth in the claims.

DESCRIPTION OF THE DRAWING

FIG. 1 is a partially broken-away side view of a liquid cooling tower in accord with this invention.

FIG. 2 is an enlarged partial side view of one embodiment of a louver panel assembly from the cooling tower of FIG. 1.

FIG. 3 is a broken-away perspective, partially exploded view of the louver panel assembly of FIG. 2.

FIG. 11 is a perspective view of another embodiment of the invention.

FIG. 12 is a broken-away view of another embodiment of the invention.

FIG. 13 is a perspective view of another embodiment of the invention.

FIG. 14 is a perspective view of another embodiment of the invention.

DESCRIPTION OF PREFERRED EMBODIMENTS

Figure 4:
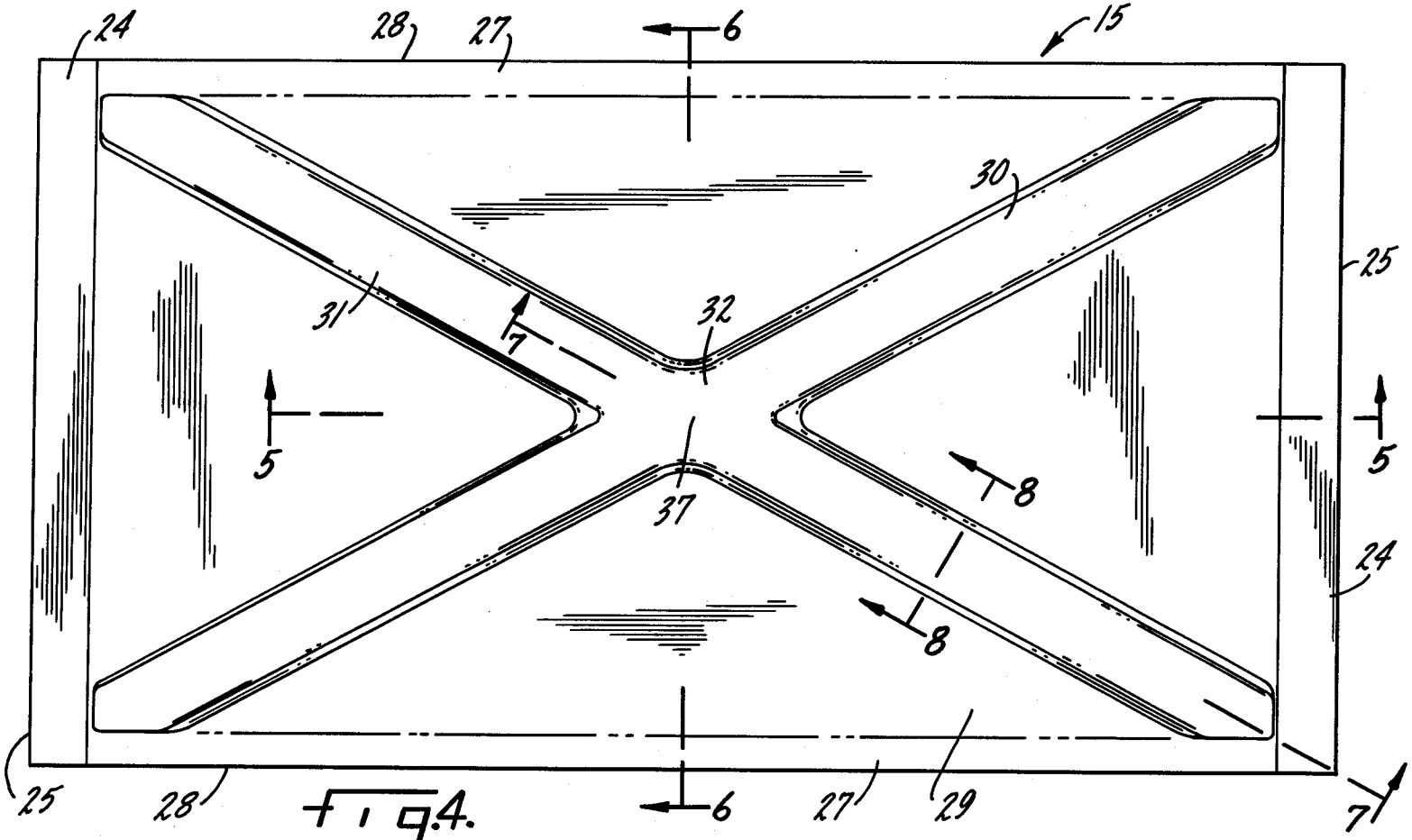
FIG. 4 is a plan view of the louver panel of FIGS. 2 and 3.
Figures 5, 6, 7, 8, 9, 10:
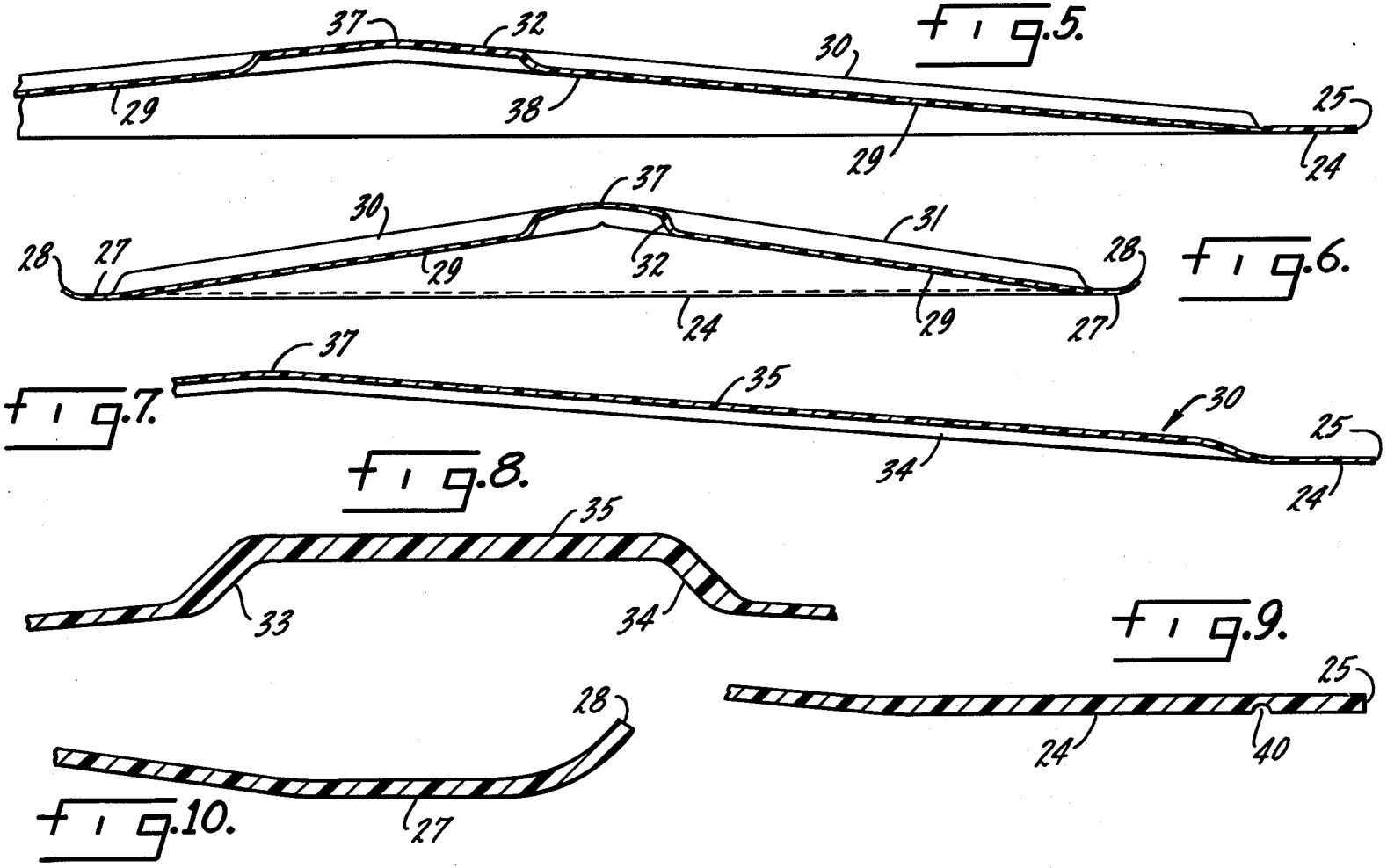
FIG. 5 is a cross sectional view taken along the line 5—5 in FIG. 4.
FIG. 6 is a cross sectional view taken along the line 6—6 in FIG. 4.
FIG. 7 is a cross sectional view taken along the line 7—7 in FIG. 4.
FIG. 8 is a cross sectional view taken along the line 8—8 in FIG. 4.
FIG. 9 is an enlarged cross sectional view of one end portion of the louver panel of FIG. 4.
FIG. 10 is an enlarged cross sectional view of the other end portion of the louver panel of FIG. 4.

FIG. 1 shows a cross flow cooling tower 5 having a water distribution pan 6 at its upper end. Water being cooled is pumped through inlet pipe 7 into pan 6 from which it is discharged under the influence of gravity through suitable metering outlets 8 into chambers 9 for conventional fill or packing (not illustrated). After falling through and over such fill, the cooled water is collected in a basin 10 from which it is recovered for recycle or disposal. Fan 12 is rotated in stack 13 by drive means 14 and this draws air through the tower for discharge up and out of the stack. Air enters the outer side wall of tower 5 through openings defined by vertically spaced rows of unitary louver panels 15 in accord with this invention. The air passes through the fill or packing and the falling water in chambers 9 where the water is cooled in the usual manner. Louver panels 15 direct and promote relatively uniform flow of air into tower 5 and also catch splashing or wind blown water and cause it to drain into basin 10.

FIGS. 1-3 show how louver panels 15 may be mounted on but inclined away from tower 5 at an angle in the range of 30°-60° to the vertical. A plurality of generally vertically extending louver support columns 17 are spaced horizontally around the outside of tower 5. Rows of horizontally aligned louver support arms 18 are spaced vertically along columns 17, and arms 18 extend transversely outwardly from columns 17. Rows of louver support brackets 20 have their lower portions 21 connected to columns 17 and their upper portions 22 connected to arms 18. The outer edges of each louver panel 15 define a generally rectangular outline. One pair of parallel edge portions 24 of each panel are flat and lie in a single plane. In each row of louver panels 15, the edge portions 24 of alternate panels are fastened directly to a pair of adjacent brackets 20. The terminal ends 25 of the edge portions 24 of such alternate panels extend beyond the brackets 20 so as to provide surfaces to which the corresponding edge portions 24 of the remaining panels 15 in each row can be attached. Fasteners 26, such as bolts or screws, may be used to attach edge portions 24 of panels 15 to each other and to brackets 20.

Each panel 15 also has another pair of parallel edge portions 27 which extend perpendicular to and intersect edge portions 24. The other pair of edge portions 27 are oriented generally horizontally when the panels are attached to tower 5. The terminal edge 28 of each portion 27 may curve outwardly away from the tower to add strength to panel 15 and to promote air flow. The body 29 of panel 15, which includes all parts of the panel between the two pairs of edge portions 24 and 27, lies entirely outside of the single plane that includes edge portions 24. A pair of identical straight ribs 30 and 31 extend diagonally across body 29. The ribs begin near the opposite corners of the panel's rectangular outline adjacent the intersection of edge portions 24 and 27. Ribs 30 and 31 intersect and merge at the central portion 32 of panel 15 and define an X-shaped projection. Each rib may include generally outwardly extending flanges 33 and 34 connected to a generally flat web 35. Central portion 32, where ribs 30 and 31 intersect, curves outwardly away from the webs 35 of the ribs, and the center 37 of portion 32 at the center of the panel projects farther from the single plane of edges 34 than any other portion of body 29. This causes the surface 38 of body 29 which faces the interior of tower 5 to be generally concave. Edge portions 24 include a groove 40 for receiving a mastic or gasket material that seals the joint where portions 24 on adjacent panels overlap.

Water splashing on louver panels 15 will freeze during cold weather. If large pieces of ice build up on the lowermost edge portion 27, such ice can damage the tower fill in a chamber 9 when warm weather causes the ice to fall from the louver. To prevent ice from forming at the edge of louver panels 15, a ledge 42 may be formed integrally with the panels. Ledge 42 extends across panel 15 between edge portions 24 and is spaced inwardly from the lower edge portion 27. Ledge 42 holds ice away from the panel edge until warm weather melts the ice, thus preventing falling ice from damaging the tower fill or causing a safety hazard to people in or near the tower. Holes or perforations 43 in ledge 42 permit water that splashes on the ledge and melted ice to drain off the panels in a controlled manner. The terminal end 28 of the lower edge portion 27 of panel 15 can project or curve inwardly, as shown in FIGS. 12 and 13. Since the panel is inclined to the vertical, the lower edge portion 27 will define an inwardly extending trough at 45 that will catch and hold ice as described above. Holes 46 permit water to drain from the panels. The lower edge portion 27 can slant downwardly as at 47 in addition to projecting inwardly, as shown in FIG. 13. This increases the quantity of ice that can be safely retained on the panel.

Another way of attaching louver panels to vertical support columns 17 is shown in FIG. 14. Each panel 15 has an integral, flat, generally triangularly-shaped mounting arm 48 extending perpendicularly from one edge portion 24. Each arm 48 is attached directly to a column 17. The flat edge portion 24 at the opposite end of each panel 15 is attached to the flat edge portion 24 adjacent the arm 48 of the next panel 15 in its row of panels. The remaining panels in each row are attached to tower 5 in the same manner except for the panel at the opposite end of the row of panels, which will not have an adjacent panel to which its end portion 24 can be attached. The portion 24 of such endmost panel may be attached to a column 17 by a support arm 18 and bracket 20 as shown and described with reference to FIGS. 1–3, or an arm 48 may extend from both edge portions of such endmost panel.

Figure 15:
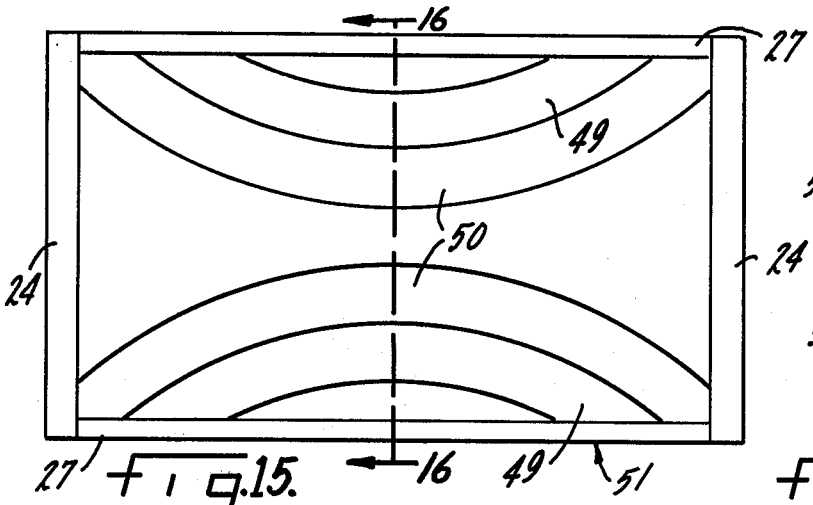
FIG. 15 is a plan view of another embodiment of the invention.
Figure 16:
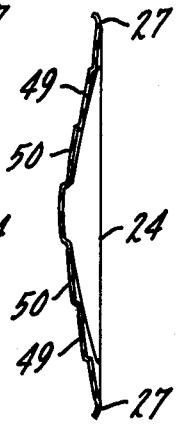
FIG. 16 is a cross sectional view taken along the line 16—16 in FIG. 15.
Figure 17:
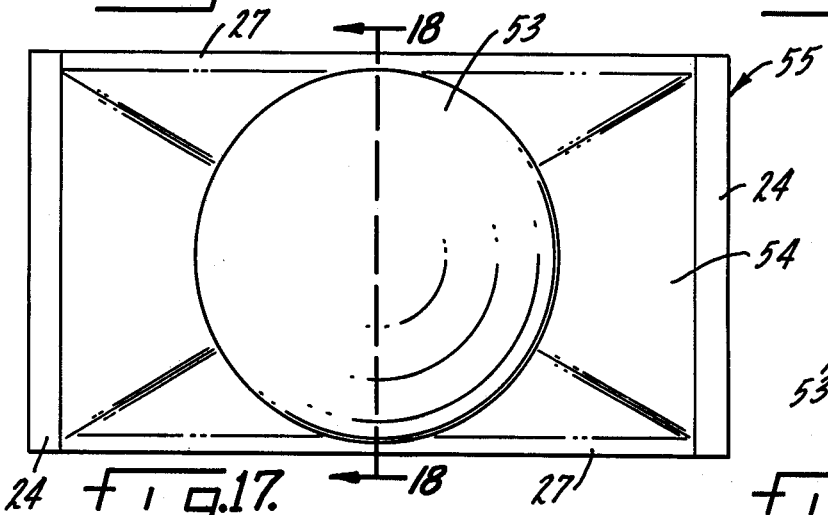
FIG. 17 is a plan view of another embodiment of the invention.
Figure 18:
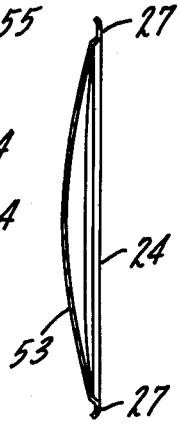
FIG. 18 is a cross sectional view taken along the line 18—18 in FIG. 17.
Figure 19:
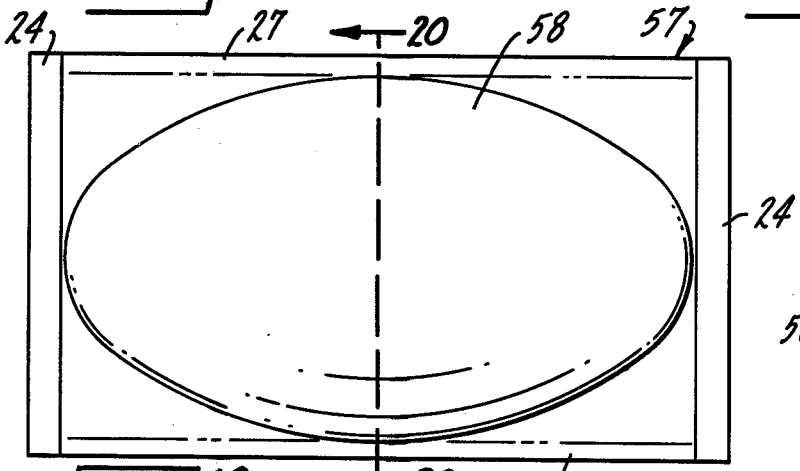
FIG. 19 is a plan view of another embodiment of the invention.
Figure 20:
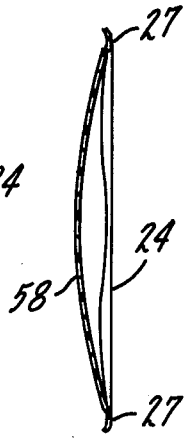
FIG. 20 is a cross sectional view taken along the line 20—20 in FIG. 19.
Figure 21:
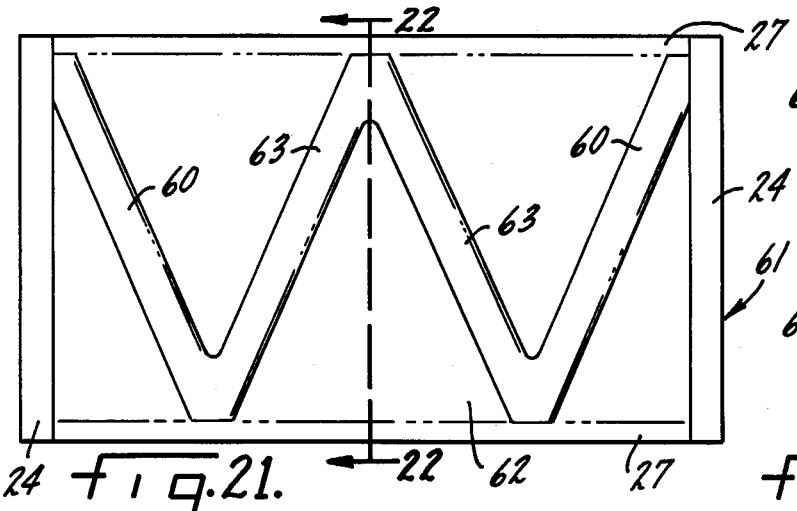
FIG. 21 is a plan view of another embodiment of the invention.
Figure 22:
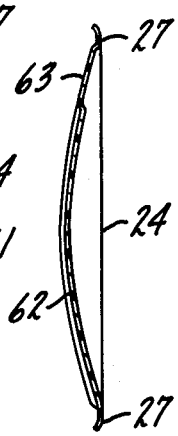
FIG. 22 is a cross sectional view taken along the line 22—22 in FIG. 21.
Figure 23:
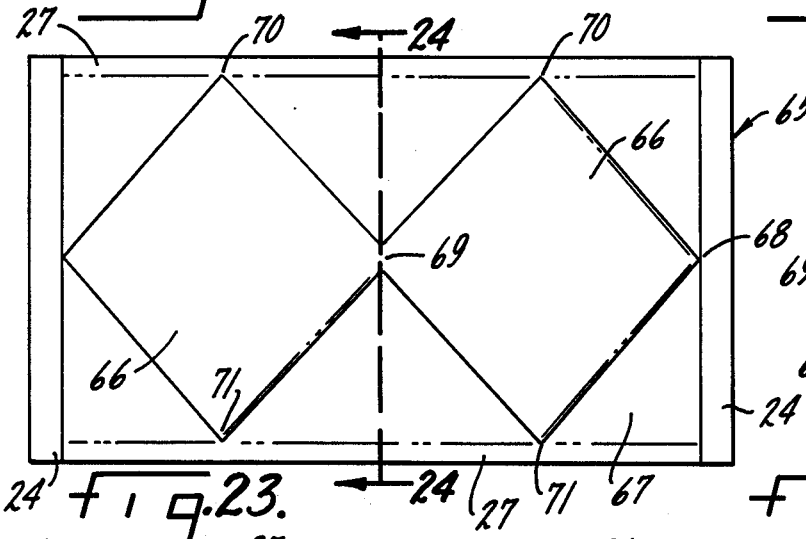
FIG. 23 is a plan view of another embodiment of the invention.
Figure 24:
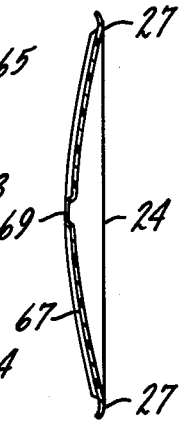
FIG. 24 is a cross sectional view taken along the line 24—24 in FIG. 23.
Figure 25:
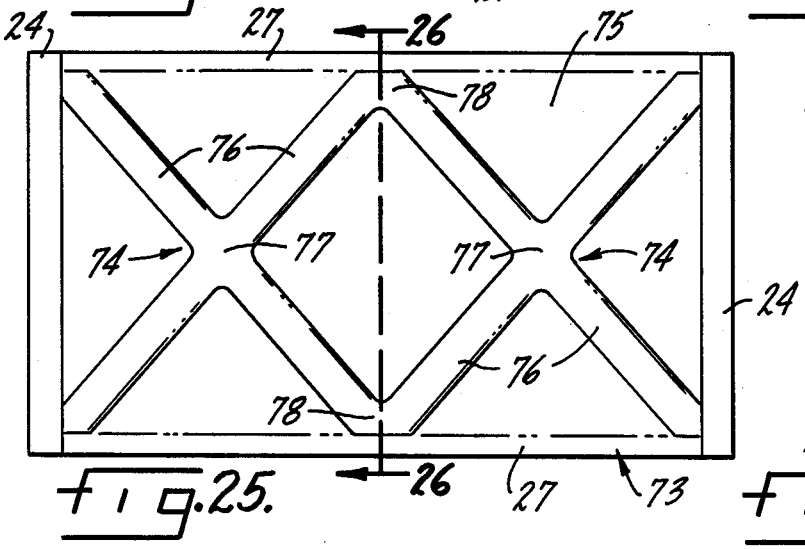
FIG. 25 is a plan view of another embodiment of the invention.
Figure 26:
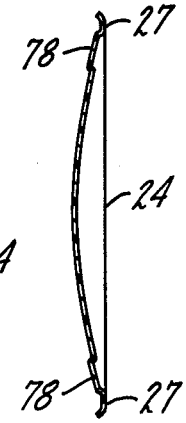
FIG. 26 is a cross sectional view taken along the line 26—26 in FIG. 25.

FIGS. 15–26 show other embodiments of generally concave louver panels 51, 55, 57, 61, 65 and 73 that are substantially identical to the embodiments of FIGS. 2–10 except for the shape of the panel reinforcing ribs or figures that project from their outer surfaces. In each of these other embodiments the edge portions 24 of the louver panel lie in a single plane, and the body of the louver panel (i.e. between edge portions 24 and 27) is entirely outside of that single plane. In FIGS. 15 and 16 pairs of identical curved ribs 49 and 50 extend between the corners on either the top or the bottom of panel 51 adjacent the intersections of end portions 24 and 27. Ribs 50 do not intersect each other. In FIGS. 17 and 18 a truncated spherical blister 53 is centered at the center of the body 54 of louver panel 55. FIGS. 19 and 20 show a panel 57 having an oval blister 58 centered at the center of the panel. In FIGS. 21 and 22 a pair of identical straight ribs 60 begin at the corners adjacent the intersection of one edge portion 27 and one edge portion 24 of panel 61 and extend at an angle across the body 62 of the panel to the opposite edge portion 27 at about one-quarter of the distance between edge portions 24. Another pair of identical ribs 63 each begin at approximately the center of such one edge portion 27 and extend at an angle across body 62 until they intersect and merge with ribs 60 at the opposite edge portion 27. Ribs 60 and 63 define a W-shaped projection on body 62. FIGS. 23 and 24 show a panel 65 having a pair of identical diamond-shaped projections 66 on its body 67. One corner 68 of each diamond is located at the center of an edge portion 24, and the opposite corners 69 merge into each other at the center of the panel. The remaining corners 70 and 71 are located at the edge portions 27 at about one-quarter of the distance separating edge portions 24. FIGS. 25 and 26 show a panel 73 having a pair of identical X-shaped projections 74 on its body 75. Each projection 74 is defined by straight ribs 76 which begin at one corner of body 75 adjacent the intersection of an edge portion 24 and an edge portion 27; the ribs 76 extend to approximately the center of the opposite edge portion 27. Ribs 76 merge at 77 about half way between edge portions 27 and about one-quarter of the distance between edge portion 24. The ends of ribs 76 merge into each other at 78 adjacent edge portions 27.

The louver panels disclosed herein may be made by molding, stamping or bonding suitable metallic, plastic or fiber reinforced materials. The cross section of various portions of each panel may be thickened with additional material or reinforced by molded-in ribs for increased stiffness. It is preferred that the louver panels be fabricated by molding chopped fiberglass, fiberglass woven rovings or metal reinforcing mesh, and a plastic resin into a unitary structure that is resistant to weathering and to fungus and bacteria attack.

It has thus been shown that by the practice of this invention, louver panels for a liquid cooling tower are shaped to withstand wind and ice loads without requiring reinforcing structure that impedes air flow or causes unnecessary ice build-up. The generally concave shape of the panels also is relatively streamlined and effectively channels air into the tower without excessive turbulence. The panels control the flow of water that splashes on them, and the amount and location of ice that can form on the panels is regulated.

While the present invention has been described with reference to particular embodiments, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. A liquid cooling tower having means for delivering liquid and for causing such liquid to fall within said tower, an air inlet, an air outlet, means for causing air to flow from said inlet to said outlet so as to intersect the liquid falling within the tower, and an improved louver assembly at said inlet comprising:

A. a plurallity of horizontally spaced, generally vertically extending louver support columns;

B. a plurality of louver support arms spaced vertically along said columns, said arms extending transversely from said columns;

C. a plurality of louver support brackets, each bracket having an upper portion connected to an arm and a lower portion connected to a column;

D. a plurality of louver panels, the outer edges of each panel defining a generally rectangular outline with one pair of parallel edge portions being attached to said louver support brackets, and the other pair of parallel edge portions being oriented generally horizontally, said one pair of edge portions being substantially flat and lying in a single plane and the entire body of said panel extending between said pairs of edge portions lying outside of said single plane.

2. The invention defined in claim 1, wherein the surface of said body facing the interior of said tower is generally concave.

3. The invention defined in claim 1, wherein a pair of ribs project outwardly from the opposite surface of said body.

4. The invention defined in claim 3, wherein each of said ribs extend across said body from opposite corners of said rectangular outline.

5. The invention defined in claim 3, wherein said ribs intersect at the center of said body.

6. The invention defined in claim 3, wherein said ribs are curved and each rib begins and ends adjacent a corner of the same one of said other end portions.

7. The invention defined in claim 5, wherein the intersection of said ribs is spaced farther from said single plane than any other portion of said body.

8. The invention defined in claim 5, wherein said ribs define an X-shaped projection.

9. The invention defined in claim 1, wherein a rounded blister is centered at the center of the panel body.

10. The invention defined in claim 9, wherein said rounded blister is a truncated sphere.

11. The invention defined in claim 9, wherein said rounded blister is an oval.

12. The invention defined in claim 1, wherein four ribs extending from the opposite surface of said body define a W-shaped projection.

13. The invention defined in claim 1, wherein a pair of identical diamond-shaped projections extend from the opposite surface of said body.

14. The invention defined in claim 1, wherein a pair of identical X-shaped projections extend from the opposite surface of said body.

15. The invention defined in claim 1, wherein the terminal edges of said other edge portions curve away from said tower.

16. The invention defined in claim 1, wherein said one pair of edge portions includes a groove for receiving a sealing material.

17. The invention defined in claim 1, wherein a perforated ice holding ledge extends across the surface of said body facing the interior of said tower.

18. The invention defined in claim 1, wherein the terminal edge of the lowermost of said other edge portions curves toward the inside of said tower and is perforated.

19. The invention defined in claim 1, wherein a surface of each panel facing the interior of said tower has means projecting therefrom for preventing ice from forming on the lowermost edge of said panel.

20. The invention defined in claim 19, wherein said projecting means on each panel comprises a ledge located above the lowermost edge of said panel.

21. The invention defined in claim 19, wherein the surface of each panel facing the inside of said tower is concave, and said projecting means is the lowermost edge of said panel being curved inwardly toward the inside of said tower so as to define a trough.

22. The invention defined in claim 21, where said lowermost edge slants downwardly.

23. The invention defined in claim 1, wherein said body of said panel curves toward the interior of said tower.

24. The invention defined in claim 1, wherein an arc shaped projection extends from the surface of said body.

25. The invention defined in claim 1, wherein a pair of arc shaped projections extend from the surface of said body.

26. The invention defined in claim 1, wherein a diamond shaped projection extends from the surface of said body.

27. The invention defined in claim 1, wherein a circular projection extends from the surface of said body.

28. The invention defined in claim 1, wherein intersecting projections extend from the surface of said body.

29. A liquid cooling tower having means for delivering liquid and for causing such liquid to fall within said tower, an air inlet, an air outlet, means for causing air to flow from said inlet to said outlet so as to intersect the liquid falling within the tower, and an improved louver assembly at said inlet comprising:

A. a plurality of horizontally spaced, generally vertically extending louver support columns;

B. a plurality of rows of louver support arms spaced vertically along said columns, said arms extending transversely from said columns;

C. a plurality of rows of louver support brackets, each bracket having an upper portion connected to an arm and a lower portion connected to a column;

D. a plurality of rows of louver panels, the outer edges of each panel defining a generally rectangular outline, one pair of parallel edge portions of alternate louver panels in each row being attached to said louver support brackets, and the terminal ends of said one pair of edge portions extending beyond said brackets, each of the remaining louver panels in each row having one pair of corresponding edge portions connected to the terminal edges of the adjacent alternate louver panels in its row, the other pair of parallel edge portions of each louver panel being oriented generally horizontally, said one pair of edge portions of each louver panel being substantially flat and lying in a single plane and the entire body of each louver panel extending between said pairs of edge portions lying outside of said single panel.

* * * * *